United States Patent [19]

Seme, Sr.

[11] 4,203,700

[45] May 20, 1980

[54] ARTICULATING PART HANDLING DEVICE

[76] Inventor: Joseph P. Seme, Sr., 17607 Egbert Rd., Walton Hills, Ohio 44146

[21] Appl. No.: 879,719

[22] Filed: Feb. 21, 1978

[51] Int. Cl.[2] ..... B65G 47/91

[52] U.S. Cl. ..... 414/732; 198/600; 414/737; 414/763

[58] Field of Search ..... 214/1 Q, 1 BV, 1 BD, 214/1 BS, 1 F, 1 D, 6 FS, 147 T, 339, 340; 193/35 R, 35 SS; 198/539, 600, 782; 269/266; 414/732, 737, 738, 432, 433, 677, 763, 783

[56] References Cited

U.S. PATENT DOCUMENTS

| | | | |
|---|---|---|---|
| 1,361,985 | 12/1920 | Hague | 214/1 BD |
| 3,391,802 | 7/1968 | Austin | 214/1 BD |
| 3,984,009 | 10/1976 | Holroyd | 214/1 BD X |
| 4,056,198 | 11/1977 | Boserup | 214/1 BV X |

FOREIGN PATENT DOCUMENTS

| | | | |
|---|---|---|---|
| 1804928 | 5/1970 | Fed. Rep. of Germany | 214/6 FS |

*Primary Examiner*—L. J. Paperner

*Attorney, Agent, or Firm*—Maky, Renner, Otto & Boisselle

[57] ABSTRACT

An articulating, part handling device to vary the orientation of the part carried thereby includes a carriage having a vacuum system positively to retain the properly located part thereon during handling. Such carriage is slidably mounted for selective reciprocal movement along the distal member of an articulating arm assembly, which is proximally pivotally mounted to a fixed supporting frame. The part handling device includes an actuating system to provide relative pivotal movement between the articulating arm assembly and frame and between the respective members of the articulating arm assembly and also to provide the relative axial movement between the carriage and distal arm, whereby the orientation of the carried part may be varied as required by the handling environment.

8 Claims, 4 Drawing Figures

2
2
P
10
20
18
23
19
21
26
34
40
12
89
53
43
23B
14A
59
58
65
14
70
67
69
91
82
86
88
87
79
77
80
16
15
68
72

ARTICULATING PART HANDLING DEVICE

SUMMARY AND BACKGROUND OF THE INVENTION

The present invention relates as indicated to an articulating part handling device in general, and to an articulating arm assembly therefor in particular in which the relative angular and axial movements may selectively be implemented to reorient the handled part as required by the application and the spacial confines of such application.

In various part handling applications, a newly formed part must be removed from a forming press and then reoriented for subsequent trimming or the like. For example, in the manufacture of automobiles, quarter panels are formed in a press and are then removed, inverted, and inserted into a trimming press. Several part handling devices are presently conventionally employed to effect the part movements just described for the automobile quarter panels.

Specifically, the part may be removed from the forming press by an extractor arm mounted to the head of such press. Such extractor arm, for example, of the type sold under the trademark LINARC by ISI Manufacturing, Inc. of Frazier, Michigan, includes a pivotal major arm having an angular lifting device with clamping jaw members at its distal end. Such jaw members are actuated to engage the lateral edge of a part when the forming press has completed its operation and has opened, and the major pivotal arm is then pivotally actuated to remove the part from the forming press and to swing the same through the arc of approximately 90°. The free end of such part after describing its arc is deposited on a moving conveyor belt which imparts the remaining rotational movement to the extracted part to complete its 180° turn over movement. In timed relationship, the extractor arm clamping jaws are released to permit the part to move down the conveyor belt.

While such extractor arm is operative to unload and flip the handled part, such movement is obtained only by gripping one limited portion of the part and then swinging the rest of the part thereabout in relatively uncontrolled movement onto the conveyor, which may result in damage to the part. Moreover, such part must then be subsequently handled by additional equipment to load the trim press or the like.

Alternatively, the part may be removed under more controlled conditions from the press in its formed orientation. However, such part must then be inverted and loaded into the trim press. To this end, several flipping or inverting arrangements have been developed. For example, an S-shape flipper, which is rotatably centrally mounted, may have each of its rebent reception pockets configured tightly to receive and nest the part delivered thereto by a first conveyor. Such nested part is then inverted by the S-shape flipper being rotated about its central axis to present the inverted, nested part to a second removal conveyor. However, such part as thus inverted must again be handled by additional subsequent equipment to load the same into the trim press. In addition, such S-shape flipper has limited, if any, adaptability for handling parts of differing configuration because the rebent reception pockets must tightly receive and nest the part for rotative inversion to minimize or eliminate part damage caused by uncontrolled movements and impacts.

Finally, a floor mounted flipper, manufactured by Atlas Manufacturing Co. under the trademark ATO, has been commercially used. Such ATO flipper moves the withdrawn part through a translatory path toward the floor and then over upon itself toward downstream handling equipment. Such ATO flipper requires significant floor space and subsequent handling equipment to place the inverted part upon the trim press or the like.

The principal object of the present invention is to invert and load or unload a formed part under controlled handling conditions. By positioning locating and holding the handled part, the present invention may perform the handling functions desired without part damage.

It is yet another object of the present invention to provide an articulating part handling device operative to load or unload presses or the like and invert the part while handled, with such device having the adaptability to handle parts of varying sizes in environments of varying spacial clearances. To this end, the articulating arm assembly has fixed and movable pivot points selectively to provide differing relative angular movements between the arms which may be coupled with selective variable axial movements between the distal arm and part carriage to provide the inverting and loading or unloading functions in the space permitted.

Other objects and advantages of the present invention will become apparent as the following description proceeds.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principle of the invention may be employed.

DESCRIPTION OF THE DRAWING FIGURES

DETAILED DESCRIPTION OF THE PREFERRED EMBODIMENTS

Figures 1, 4:
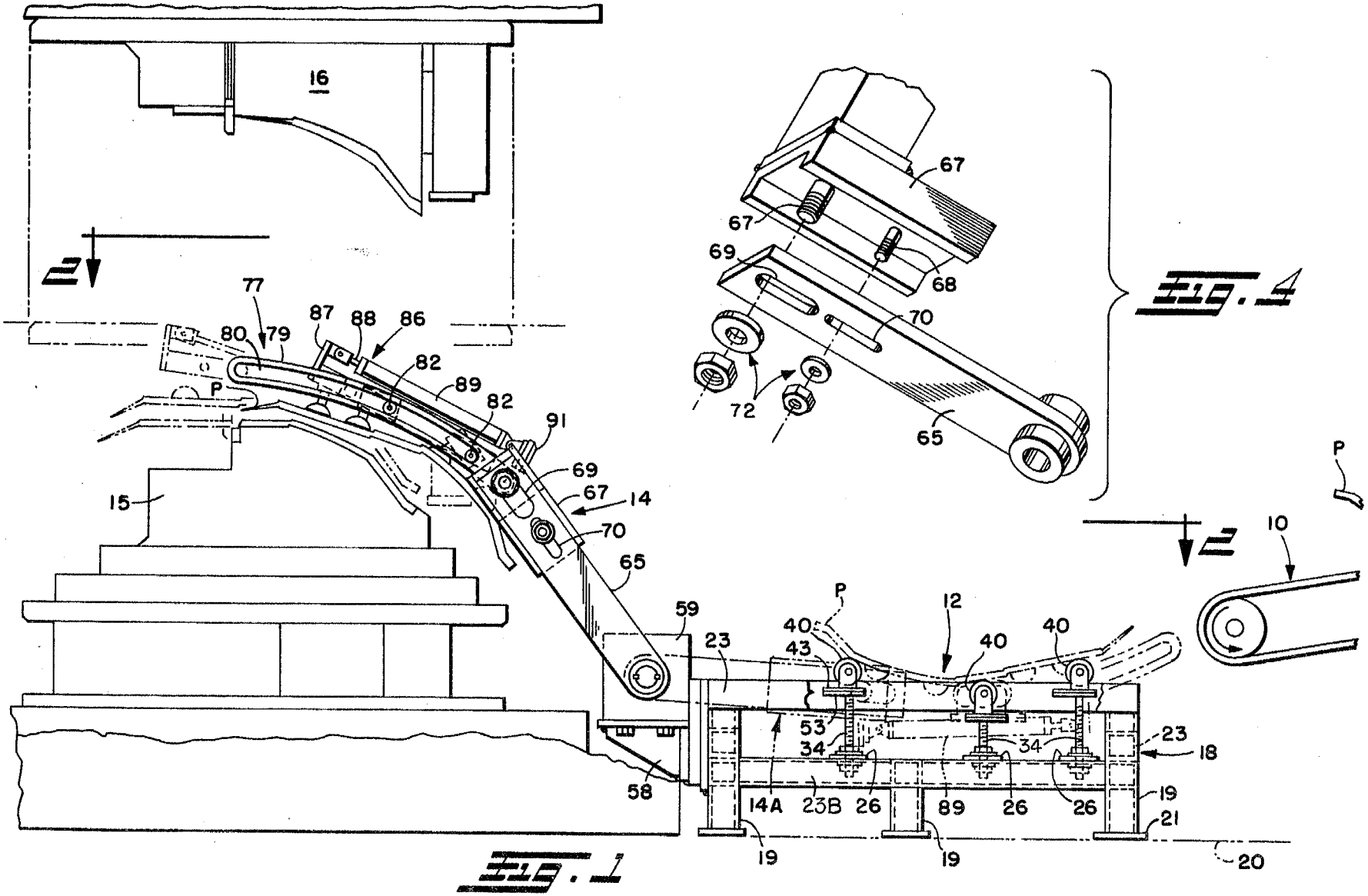
FIG. 1 is a side elevation of the articulating part handling device of the present invention with the phantom lines indicating different relative positions for the articulating arm assembly and with a portion of the supporting frame being broken away to illustrate the part locating and support rollers.
FIG. 4 is a fragmentary exploded perspective showing in detail the adjustability of the pivot axis for the second arm assembly relative to the fixed pivot axis for the first arm assembly.

Referring now in more detail to the drawings and initially to FIG. 1, an endless rough top, rubber belt conveyor, indicated generally at 10, selectively serially delivers part, such as the automobile quarter panels P illustrated, from a forming press (not shown) longitudinally to the part reception and locating assembly indicated generally at 12. The thus received and located part P is positively secured to and then transported by an articulating arm assembly, indicated generally at 14, with the illustrated transporting movement of the articulating arm assembly resulting in inversion of the part and vertical alignment of the same with the lower head 15 of a trim press when the upper head 16 thereof is in its elevated, open position. The part is then released accurately to place the same on such lower trim press head, and the articulating arm assembly 14 is then returned to its nested position within the part receiving and locating assembly 12 to repeat the above described cycle. Alternatively, of course, the cycle could be reversed by using the articulating arm assembly to remove a part from a press and invert the same for subsequent deposit on and removal by a part locating, reception and removal assembly. The articulating part handling device of the present invention will be described in more detail hereinafter by a specific description of the part reception and locating assembly 12, of the articulating arm assembly 14 and of the interrelated operations thereof.

THE PART RECEPTION AND LOCATING ASSEMBLY 12

The part reception and locating assembly 12 includes a fixed supporting frame indicated generally at 18 that has a plurality of tubular uprights 19 secured at their lower ends to the floor 20 as indicated at 21. Such uprights 19 are interconnected both longitudinally and laterally by generally horizontally extending beams 23. The centrally located, longitudinally extending parallel beams 23A and B, which are located below the outside longitudinal beams, are each provided with an elongated slot 24 in the top wall thereof to permit selective longitudinal positioning of transversely extending roller assembly mounting members 26.

Figures 2, 3:
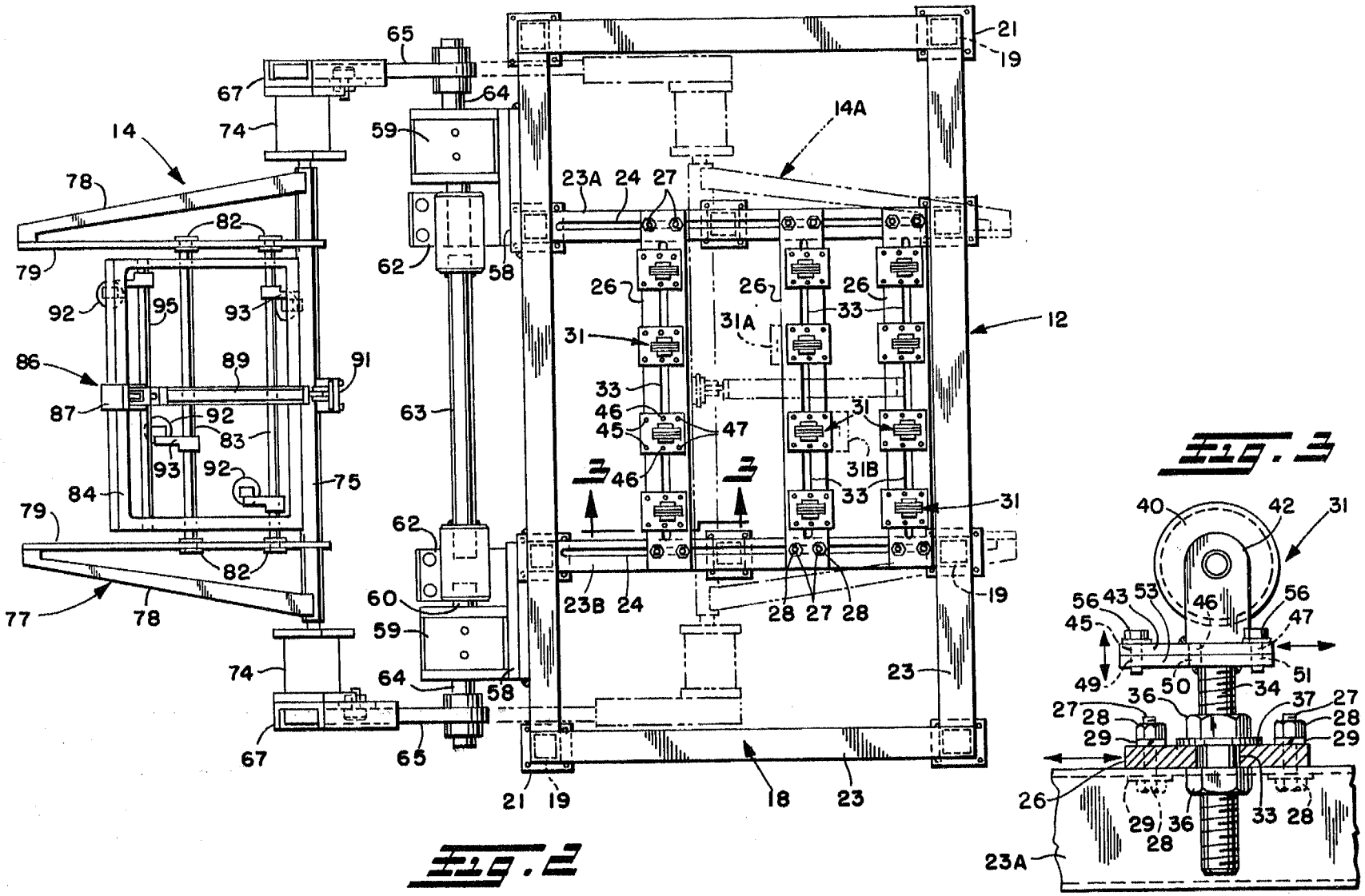
FIG. 2 is a plan view of the articulating part loading device taken substantially along the plane 2—2 of FIG. 1, with the handled part being eliminated for clarity of illustration.
FIG. 3 is a fragmentary vertical section taken along plane 3—3 in FIG. 2 showing in detail a part locating and support roller assembly, which is variably located on and carried by the fixed frame.

Such mounting members 26 have two clamping assemblies at each end thereof, each of such clamping assemblies including two threaded shanks 27 passing through supporting member 26 and slot 24 and having opposed nuts 28 and washers 29 threaded on opposite ends thereof. As shown in FIG. 3, the washers 29 respectively bear against top of the mounting member 26 and the inside surface of the top wall of beam 23A, with the top nut 28 being selectively loosened to permit longitudinal repositioning of the respective mounting member 26 and then being retightened firmly to clamp the mounting member 26 in the position selected. Although three such adjustable mounting members 26 are illustrated, any number of the same may be used depending upon the type of part being handled and upon the required number of, and the required positioning for, the roller assemblies 31.

Such roller assemblies 31 may be selectively transversely adjusted and located by movement along elongated slots 33 in each of the mounting members 26. The number of roller assemblies on each mounting member and the relative positioning thereof are selected according to the configuration of the part being handled. All of the roller assemblies 31 are identical in construction, and for ease of description, only a single roller assembly is described in conjunction with FIG. 3.

Such roller assembly 31 includes a threaded vertically extending shank 34 that passes through the slot 33 in mounting member 26. A lower nut 36 and washer 37 and an upper nut 36 and washer 37 are threaded onto shank 37 on opposite sides of mounting member 26. The opposing nuts and washers may be tightened against the opposite faces of the mounting member 26 clampingly to secure the shank to such mounting member at the desired transverse location. Alternatively, the opposing nuts 36 and washers 37 may be loosened to permit transverse movement of the roller assemblies 31 along slot 33 until the selected location therefor is obtained and the clamp effected.

In addition, the opposed nut and washers may be vertically moved along the threaded shank prior to such clamping to obtain variation in the positioning of the shank relative to the mounting member 26. As shown in FIG. 1, such relative vertical variation permits selectivity in the height of the various rollers 40 relative to the mounting member 26 to provide adaptability in handling parts of various contours and/or to permit the downstream row of rollers to act as stops to the advancement of the part P.

Each roller 40 preferably has a finned surface for cushioning the part supported thereby and is rotatably mounted in a pillow block bearing 42. The mounting flange 43 of pillow block 42 includes three spaced pairs 45–47 of mounting holes that are selectively aligned in whole or in part with similarly spaced pairs 49–51 of mounting holes on plate 53 welded to the top of shank 34. As illustrated in phantom lines 31A and B in FIG. 2, the respective mounting flanges 43 of the pillow blocks may be positioned in three different locations relative to the respective plate 53 to obtain alignment between at least two pairs of holes in each of the two plates. Fasteners 56 may then be passed through such aligned pairs of holes to secure the pillow block and roller to the plate 53 on shank 34. The three different possible mounting locations for each pillow back 42 and roller 40 provide still further longitudinal locating adaptability for the various rollers as illustrated in FIG. 2, thereby to provide support for and accurate locating of the part to permit the same to be picked up by the articulating arm assembly 14 nested therebelow, as indicated in the phantom lines 14A of FIG. 1.

ARTICULATING ARM ASSEMBLY 14

The articulating arm assembly 14 is pivotally mounted to the downstream end of the fixed frame 18 for selective angular movement relative thereto. To effect such pivotal mount, two transversely spaced cantilevered supports 58 are securely mounted to the frame 18 at its downstream end. A dual shafted hydraulic rotor 59 of the type manufactured by Roto Actuator Corporation under the trademark TORKMOR is mounted on top of each cantilevered support 58. The inner or facing shafts 60 of the transversely spaced dual shafted rotors 59 are coupled to shock absorbing units 62, with the two shock absorbing units being interconnected by a synchronizing shaft 63. The shock absorbing units are of conventional construction and may be purchased, for example, from ISI under the trademark SUPER-SHOK. Such shock absorbing units operate to eliminate the transmission of sudden jolts to the carried part that might otherwise be caused by hydraulic lags or the like.

The outer shafts 64 of the two dual shafted rotors 59 respectively have first arm members 65 keyed thereto for pivotal movement therewith. Such first arms 65 for the articulating arm assembly are effectively adjustable in length to vary the pivot axis for the second arm assembly, thereby to permit the articulating arm assembly to be adapted to the spacial confines of the part handling environment. As best shown in FIG. 4, such effective length adjustability is achieved by a telescopic distal channel member 67 being received about and axially movable with respect to each of such first arms 65. Such relative axial movement is guided by two threaded pins 67 and 68 carried by and projecting from channel 67 being respectively received in two slots 69 and 70 on first arm 65, such pins being selectively secured to arm 65 by nuts and washers 72 when the desired position for the telescopic distal channel 67 has been achieved. Each of the adjustable distal channels 67 have single shaft rotors 74 mounted to the web thereof, whereby common adjustment of the two channels 67 commonly moves the pivot axis for the two single shaft rotors 74 relative to the fixed proximal pivot axis for the first arms 65.

Such single shaft rotors, whih are of the type sold by Roto Actuator Corporation under the trademark TORK-MOR, have their single shafts commonly interconnected by a tubular shaft 75 forming part of the second arm assembly 77, which is selectively pivotally moved by the single shaft rotors 74. Such second arm assembly 77 includes two transversely spaced interconnected trusses 78 and tracks 79, which are proximally connected to and rotatable with shaft 75. The track members 79 are slightly arcuately bowed along their longitudinal extent and have elongated slots 80 respectively located therein. Such slots 80, respectively receive two sets of rollers 82 rotatably mounted on the opposed ends of two hollow tubular shafts 83 connected to the frame 84 of a carriage indicated generally at 86.

Such carriage frame 84 has an upwardly extending flange 87 at the downstream end thereof as viewed in full lines in FIG. 1, which flange 87 has the piston rod 88 of piston cylinder assembly 89 connected thereto. The cylinder end of the piston cylinder assembly 89 is connected to an upstanding flange 91 on shaft 75 of the second arm assembly. The piston cylinder assembly 89 may be selectively actuated for expansion or contraction to move the carriage 86 relative to the second arm assembly by the rollers 82 moving along the slots 80 in track members 79. The contracted condition of the piston cylinder assembly 89 and the corresponding location of the carriage 86 are indicated in full lines in FIG. 1, while the expanded or outstroked condition of the piston cylinder assembly 89 and the corresponding outstroked location for the carriage 86 are indicated in phantom lines at the left of FIG. 1.

The relatively movable carriage 86 receives and holds the part P during the loading and/or unloading movements of the articulating arm assembly 14. To this end, vacuum cups 92 made by ISI are secured, in the desired holding pattern, to the hollow tubular roller shafts 83 by Venturi-Mounts 93 also made by ISI. Suction may be applied to or released from such vacuum cups 92 through a conventional vacuum system communicating with such hollow tubular roller shafts and/or other hollow shafts, if necessary, as shown at 95. A vacuum is commonly applied to such vacuum cups from the time the part P is received on the carriage 86 until the part P is removed therefrom in the operative cycle of the part handling device of the present invention.

OPERATION OF THE ARTICULATING PART HANDLING DEVICE

As should be apparent from the above description, the operative sequence of the articulating part handling device commences with the articulating arm assembly 14 in the right hand phantom line position of FIG. 1 in which the second arm assembly 77 and carriage 86 are nested immediatley below the top surfaces of finned rollers 40 on supporting frame 18. The part P to be handled is fed from conveyor 10 onto the finned rollers 40 of such supporting frame, with the variation in vertical height of the finned rollers as shown in FIG. 1 acting accurately to stop and locate the part thus fed. In such accurately located position, the bottom surface of the part is in surface contact with the plural vacuum cups 92 mounted on the carriage 86. A vacuum through said suction cups is then established by initiation of the vacuum system positively to hold the part P on the carriage 86.

With the part thus secured, the relative pivotal movements of the articulating arm assembly 14 are initiated in whatever sequence is required to operate in the spacial confines of the working environment. Such relative pivotal movement includes the simultaneous actuation of the dual shafted rotors 59 to pivot the first arms relative to the supporting frame 18. Such pivotal movement may be before, after or simultaneous with pivotal movement of the second arm assembly 77 relative to the first arm assembly, with such second arm assembly pivotal movement being initiated by simultaneous actuation of the single shaft rotors 74. Such relative pivotal movements of the first and second arm assemblies results in the carriage 86 transcribing an arc from the supporting framework 18 to a position between the lower 15 and upper 16 heads of the trim press, such arc inverting the carried part P. The piston cylinder assembly 89 may then be outstroked to move the carriage 86 to the left as viewed in FIG. 1 relative to the second arm assembly 77 accurately to position the part immediately above the lower head of the press. When thus outstroked, the piston cylinder assembly is positively held in such position properly to locate the part P for loading. The vacuum on suction cups 92 is then released to place the part carried thereby on the lower head 16 of the trim press. To achieve the sequence just described, the rotors and piston cylinder assembly are hydraulically actuated through conventional programable hydraulic systems effective to obtain the articulating movements required for the loading application.

When the part has been thus released, the movements just described for the articulating arm assembly are hydraulically reversed to return such articulating arm assembly to the nested position within the supporting framework 18. In such nested position, the articulating arm assembly is again ready to receive another part for repetition of the above recited handling cycle. As mentioned above, the part handling cycle could be reversed to unload a part from a press, to carry the unloaded part through the inverting articulating pivotal movement, and to deposit the part on a supporting framework for removal therefrom by powered rollers or the like.

The part handling device of the present invention may also be adapted to handle different parts of different configuration in different operating environments by making the necessary adjustments therefor. With respect to the supporting framework 18, the number and location of the roll supporting members 26 may be varied as required, and the number and location of the roll assemblies 31 on such supporting members may also be varied as required. With respect to the articulating arm assembly 14, the effective length of the first arm 65 and thus the pivot axis for the rotors 74 may be varied by adjusting the telescopic distal members 67 thereon as required for the specific environment. Finally, the sequence and extent of the relative pivotal movements and carriage movement may be varied as required to develop the necessary articulation for the spacial requirements of the given operating environment.

Other modes of applying the principle of the invention may be employed, change being made as regards the details described, provided the features stated in any of the following claims or the equivalent of such be employed.

The embodiments of the invention in which an exclusive property or privilege is claimed are defined as follows:

1. An articulating part handling device comprising a fixed frame having roller members thereon properly to locate a part during receipt thereof for subsequent handling, said roller members being adjustable in at least two directions properly to locate parts of varying sizes and shapes, an articulating arm assembly having at least two pivotally interconnected members, the proximal member of such pivoting arm assembly being pivotally mounted to said fixed adjacent its proximal end, a carriage slidably mounted to the distal member of said articulating arm assembly for selective movement therealong, a part support means on said carriage including plural selectively actuated part holding means selectively to secure the properly located part on said fixed frame to the part support means at several positions across the part, and actuating means selectively to pivot the articulating assembly relative to the fixed frame and/or to pivot the members of such articulating arm assembly relative to one another and/or slidably to move said carriage relative to said distal member, thereby selectively to change the orientation of the part selectively to said carriage as required.

2. The articulating part handling device of claim 1 wherein the actuating means includes first rotor means selectively angularly to drive the articulating arm assembly relative to the frame and second rotor means selectively angularly to drive the members of the articulating arm assembly relative to one another.

3. The articulating part handling device of claim 2 wherein at least one of the members of the articulating arm assembly is adjustable in length to vary the spacing between the pivot axes for the first and second rotor means.

4. The articulating part handling device of claim 1 wherein said actuating means includes a piston cylinder assembly selectively to move said carriage relative to said distal member.

5. The articulating part handling device of claim 1 wherein said carriage has retention means thereon positively to hold the properly positioned part on said carriage during handling.

6. The articulating part handling device of claim 5 wherein said retention means includes a plurality of vacuum cups through which a vacuum is applied to hold the part on the carriage or is discontinued to release the part from the carriage.

7. An articulating part handling device comprising a frame having adjustable rollers thereon, an articulating arm assembly having at least two pivotally interconnected members, the proximal member of said articulating arm assembly being pivotally mounted to one end of a fixed frame adjacent its proximal end, a part carrying means mounted on the distal member of said articulating arm assembly, and actuating means selectively to pivot the members of the articulating arm assembly relative to the fixed frame between two selected end positions of movement and/or to pivot the members of such articulating arm assembly relative to one another, the part carrying means in one of the two end positions of the articulating arm assembly being nested in the frame adjacent the rollers, whereby a part may be carried by said part carrying means between the two end positions of movement of said articulating arm assembly for reorientation thereof, with the movement of the part support means out of or into its nested position being respectively operative to pick the part up from or deposit the part on the rollers of said frame.

8. The articulating part handling device of claim 7 wherein the part carrying means includes a carriage slidably mounted to said distal member of said articulating arm assembly for selective movement relative thereto.

* * * * *